United States Patent [19]

Huber et al.

[11] Patent Number: 4,750,676

[45] Date of Patent: Jun. 14, 1988

[54] HAND-OPERATED ELECTROSTATIC SPRAYGUN

[75] Inventors: Willi Huber, Heerbrugg; Eugen Spirig, Diepoldsau, both of Switzerland

[73] Assignee: J. Wagner AG, Switzerland

[21] Appl. No.: 718,385

[22] Filed: Apr. 1, 1985

[30] Foreign Application Priority Data

Apr. 3, 1984 [DE] Fed. Rep. of Germany ..... 3412507

[51] Int. Cl.[4] ..... B05B 5/02; B05B 9/04; B05D 1/04

[52] U.S. Cl. ..... 239/705; 239/708

[58] Field of Search ..... 239/704–708, 239/690, 527, 528, 526; 42/76 R

[56] References Cited

U.S. PATENT DOCUMENTS

| | | | |
|---|---|---|---|
| 273,288 | 3/1883 | Kacer et al. | 42/76 R |
| 1,689,848 | 10/1928 | Anderson | 239/528 X |
| 1,902,702 | 3/1933 | Jenkins | 42/76 R |
| 2,888,207 | 5/1959 | Sykes | 239/528 X |
| 3,471,089 | 10/1969 | Kock | 239/705 |
| 3,747,850 | 7/1973 | Hastings et al. | 239/707 X |
| 4,287,552 | 9/1981 | Wagner et al. | 239/708 X |

FOREIGN PATENT DOCUMENTS

| | | | |
|---|---|---|---|
| 1537997 | 7/1968 | France | 239/706 |

*Primary Examiner*—Andres Kashnikow

[57] ABSTRACT

A hand-operated electrostatic spraygun comprises a gun body, a pistol tube of insulating material, a handle, an insulation-clad high-voltage generator and a connection for paint delivery and is contructed such that the gun is particularly small, lightweight and can be effortlessly held in the hand. The gun body, preferably composed of aluminum, is an essentially cylindrical body which comprises the connection for paint delivery in the region of its forward end adjacent its forward face. The pistol tube, preferably formed of plastic, is secured to the forward face of the gun body in a manner to be secured against twisting and comprises a clover leaf-shaped cross section having two to four "leaves". The high-voltage generator is secured at the rear region of the end body to the underside thereof, whereby the cladding of the high-voltage generator is shaped as a pistol grip and forms a handle for the spraygun.

9 Claims, 1 Drawing Sheet

HAND-OPERATED ELECTROSTATIC SPRAYGUN

BACKGROUND OF THE INVENTION

1. Field of the Invention

The present invention relates to a hand-operated electrostatic spraygun which comprises a gun body, a pistol tube of insulating material, a handle, an insulation-clad high-voltage generator and a connection for paint delivery.

2. Description of the Prior Art

Hand-operated electrostatic sprayguns of the type generally set forth above, i.e. having a high-voltage generator located in the pistol barrel, are commercially available in a variety of embodiments. The high-voltage generator is usually accommodated in the pistol tube or in the handle. It is also known to attach the high-voltage generator between the pistol tube and the lower-free end of the handle as a separate component. All of these apparatus, however, share the disadvantage that, despite general efforts to the contrary, they are comparatively unfavorable in terms of size, weight and center of gravity as tools to be held in the handle for a long period of time.

SUMMARY OF THE INVENTION

It is therefore the object of the present invention to provide hand-operated electrostatic sprayguns of the type generally set forth above which are smaller, lighter in weight and easier to hold than apparatus heretofore known.

The above object is achieved, according to the present invention, in a hand-operated electrostatic spraygun having the general structure mentioned above, and in which the gun body is an essentially cylindrical body which comprises the connection for the paint delivery at the bottom of its cylindrical jacket, forward of the pistol grip and trigger as viewed in the spraying direction, in which the pistol tube is secured to the front of the gun body against twisting and comprises a clover leaf-shaped cross section having two to four "leaves", and in which the high-voltage generator is secured in the rear region of the gun body in the pistol grip below the cylinder jacket, and the cladding of the high-voltage generator is shaped such that it forms the handle or pistol grip of the spraygun.

According to the invention, therefore, the actual gun body is composed of a basically cylindrical component that is small and can be easily held, particularly because only the forwardmost portion of the gun body is subjected to the paint pressure, this being of great significance particularly given sprayguns operating with high paint pressure. The pistol tube is secured to the front end of the gun body, whereby the cross-sectional shape selected yields a substantial weight reduction because all material which is not absolutely necessary has been removed. In other words, the tube walls essentially surround only the channels extending through the pistol tube. Also contributing significantly to the weight reduction is that no separate handle is provided, rather the high-voltage generator, whose required insulation cladding is designed as a pistol grip, represents the handle. These features of the invention produce both a size reduction and a weight facilitation of the hand-operated spraygun, as well as a center of gravity that is very beneficial in terms of location of the center of gravity, this being of particular significance for holding the spraygun without tiring. This design thereby leads to a simple manufacture and assembly of the spraygun and, on the basis of slight modifications, the spraygun can be employed as a compressed air gun, as a high-pressure paint spraygun without compressed air and as a high-pressure paint spraygun with additionally supplied compressed air.

BRIEF DESCRIPTION OF THE DRAWING

Other objects, features and advantages of the invention, its organization, construction and mode of operation will be best understood from the following detailed description, taken in conjunction with the accompanying drawings, on which.

DESCRIPTION OF THE PREFERRED EMBODIMENTS

Figures 1, 2:
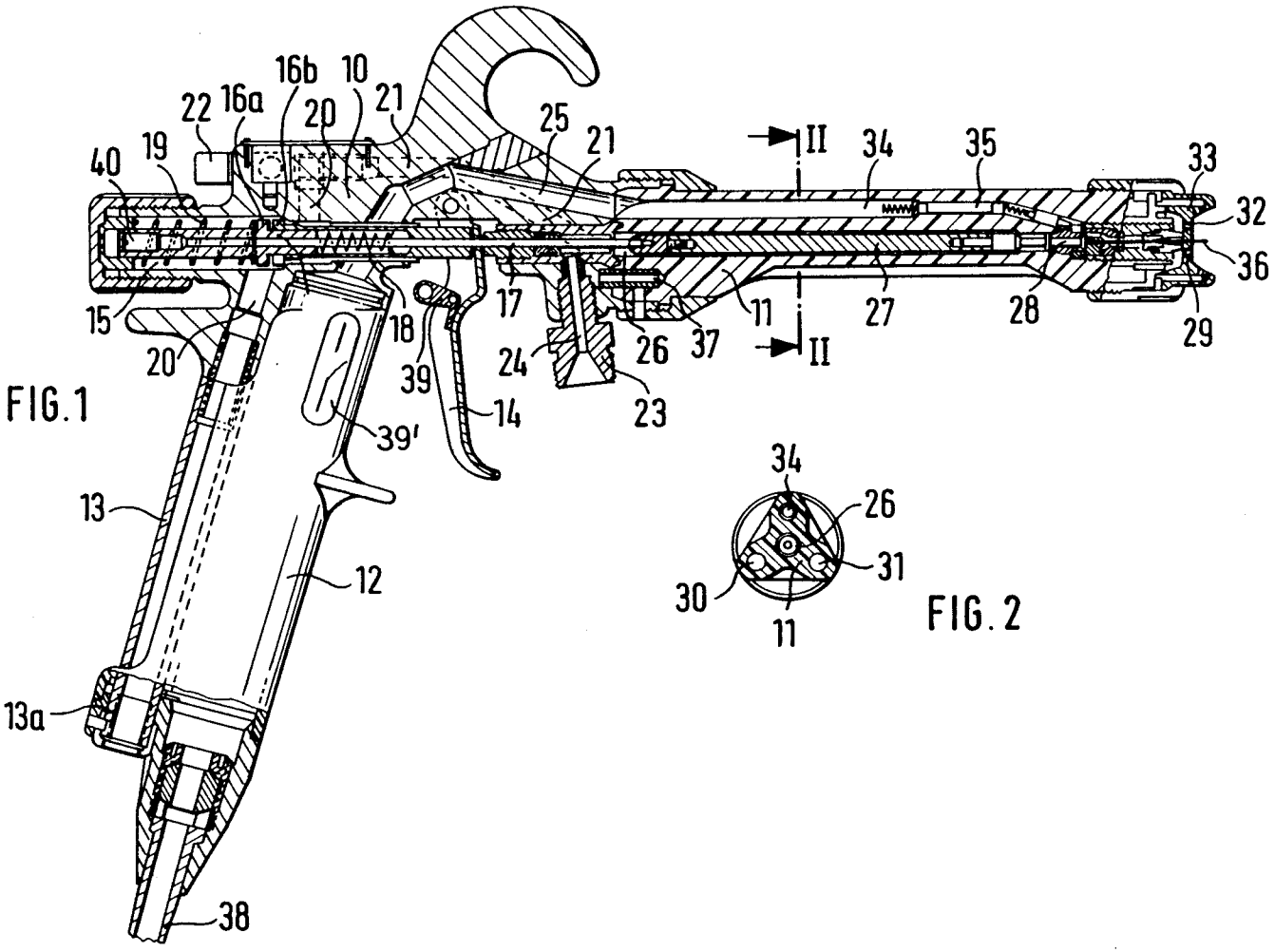
FIG. 1 is a longitudinal view of a spraygun, shown primarily in section, constructed in accordance with the present invention.
FIG. 2 is a sectional view taken generally along the parting line II—II of FIG. 1.

Referring to the drawing, the illustrated paint spraygun comprises a gun body 10, preferably constructed of aluminum, which essentially has the shape of a cylinder. A pistol tube 11, preferably composed of plastic, is screwed onto the front end of the gun body 10, the central portion of the pistol tube having a cross section in the form of a three-leaf clover in accordance with FIG. 2. Secured by screw connections in the rear region of the gun body 10 are, at the underside thereof, a high-voltage generator 12 having a plastic coating or cladding and a compressed air delivery tube 13 of metal which extends parallel to the high-voltage generator 12. Finally, a trigger 14 is hinged to the gun body 10. The paint spraygun is therefore composed of five basic elements, namely the gun body 10, the pistol tube 11, the high-voltage generator 12, the compressed air delivery tube 13 and the trigger 14. These main elements shall be described in detail below.

The gun body 10 has an elongate channel 15 therethrough in which a control member 16 is displaceably disposed and is seated on a paint valve stem with extends axially through the control channel 15. The control member 16 comprises a rigid control flange **16*a* and a control flange 16*b*, partially displaceable thereon. Coil springs 18 and 19 bear against opposite ends of the control member 16 and define the position of the control member 16 on the valve stem 17. The control channel 15 is in communication with an obliquely-extending air connecting channel, namely in the region of the control member 16. The air channel 20 is continued in two air channels 21 extending towards the forward end of the gun body 10, only one of these two channels 21 being visible in the drawing. The two channels 21 can be separately opened and respectively, closed relative to the air connecting channel 20 by way of screw plugs 22. The gun body 10 further comprises a paint connection 23 having a paint delivery channel 24 which discharges into the control channel 15 close to the forward end face of the gun body 10. Finally, the gun body 10 comprises a bore which likewise proceeds to its forward end face, a high-voltage lead 25 being accommodated in this bore. The pistol tube 11 includes a centrally disposed paint channel 26 and a valve stem 27 extends through the paint channel 26. When the pistol tube 11 is secured to the gun body 10, the paint channel 26 communicates with the control channel 15 and the valve stem 27 is tightly connected to the valve stem 17. A paint valve 28 is located at the forward end of the valve stem 27. The paint channel 26 continues beyond the paint valve 28 up to the spray nozzle 29. Also extending through the pistol tube 11 are two air channels 30 and 31, as best seen in FIG. 2, which continue the two air channels 21 of the gun body 10 when the pistol tube 11 is in place on the gun body 10, whereby the one air channel 30 discharges before the spray nozzle 29 and supplies the atomizer air for the air jets 32, whereas the air channel 31 supplies the two air horns 33 with control air. Finally, a high-voltage cable 34 extends through the pistol tube 11, the cable 34 being electrically connected to the high-voltage cable 25 of the gun body 10 and supplying the sprayer electrode 36 with electrical energy via a high-value resistor 35. The pin referenced 37 serves to define the desired rotational position of the pistol tube 11 is emplaced and mounted on the gun body 10**.

The high-voltage generator 12 has its one end screwed into the gun body 10, whereby its electrical output then contacts the high-voltage cable 25 extending through the body 10. At its other end, the high-voltage generator 12 is connected to a low-voltage supply cable 38. The high-voltage generator 12 essentially comprises a transformer, a high-voltage cascade or voltage multiplier, and an insulating cladding, whereby the cladding, as already mentioned, has the shape of the pistol grip or handle.

The compressed air delivery tube 13 has its one end screwed into the gun body 10 and has a connection at its other end **13*a* for a compressed air supply line. The tube 13 extends at the rear of the high-voltage generator 12 and is preferably releasably connected thereto for stabilization. The arrangement is undertaken such that the high-voltage generator 12** and the compressed air delivery tube can be readily grasped by the hand of the operator.

As already mentioned above, the trigger 14 is hinged to the gun body 10 and comprises a switch element 39 that can be hinged away, the switch element 39 cooperating with a proximity switch 39', for example a reed switch, located in the high-voltage generator 12 for connecting the high-voltage generator to the high-voltage lead 25.

The described electrostatic spraygun operates in the following manner. When the trigger 14 is actuated by the operator, then the movable control flange **16*b* is first displaced (towards the left on the drawing), with the consequence that the compressed air adjacent in the compressed air delivery tube, while traversing the bore 15, proceeds through the bore 20 to the two compressed air channels 21 and continues therefrom via the channels 30 and 31 to the air jets 32 and the air horns 33. As soon as the control flange 16*b* strikes the control flange 16*a*, the entire control member 16 is displaced (towards the left on the drawing), with the consequence that the paint valve 28 is opened via the interconnected valve stems 17 and 27 and the paint emerges from the sprayer nozzle 29 as a spray jet. At the same time the switch element 39 approaches so close to the proximity switch (not shown) in the handle including the high-voltage generator 12 that the proximity switch is operated and the sprayer electrode 36 is supplied with spray current from the high-voltage generator 12 via the high-voltage cables 24 and 34 and the high-value resistor 35. When the trigger 14 is released, the operation then proceeds in a correspondingly reverse manner, i.e. the paint feed is inhibited first and then the air feed is inhibited. The ratio between the atomizer air and controlled air can be arbitrarily modified by turning the screw plugs 22, and the trigger path or, respectively, the trigger resistance can be varied by turning the screw 40. When the switch element 39** is hinged away, then spraying can be carried out in a purely mechanical manner, i.e. without an electrostatic field.

The spray gun body 10 can also be fabricated of plastic, but metal, particularly lightweight aluminum in this case, is preferable because the body comprises a number of screw connections. Essential, however, is that the paint feed 23, 24 is located close to the connection of the pistol tube 11 to the gun body, particularly given spraygun operating with high paint pressure because only an insignificant portion of the gun body is then subjected to the paint pressure and the majority of the body 10 can be fashioned with thin walls for the sake of saving weight. Also of significance for the sake of saving weight is that the pistol tube 11 has the cross section that may be seen from FIG. 2 or a significant portion of its length, i.e. those portions of the two walls that are not absolutely necessary have been eliminated. Of significance, finally, with respect to saving weight and reducing size is that the cladding of the high-voltage generator itself represents the handle, in particular contrasting the heretofore traditional structure whereby the high-voltage generator (with its cladding) was introduced into a hollow handle. Plastic can likewise be selected for the compressed air delivery tube and the trigger 14, but lightweight metal is preferable.

The described electrostatic paint spraygun is distinguished by a structure that guarantees a simple manufacture of the components and a simple assembly. The particular advantage, however, is that the gun is small, sleek and significantly lighter in weight than comparable commercially-available devices. Added thereto is a very favorable center of gravity, this leading overall to the fact that the operator does not tire even given long-duration use of the paint spraygun with the integrated high-voltage generator.

The illustrated and described exemplary embodiment is a matter of a paint spraygun having compressed air atomization and auxiliary control air. The spraygun, can also be designed as an airless high-pressure gun, whereby the compressed air tube 13 is eliminated and the sprayer nozzle 29 is replaced with a corresponding high-pressure nozzle. If an even greater saving of weight is to take place in this case, the pistol tube 11 can be additionally specifically designed such that the air channels 30 and 31 are eliminated and the cross section then designed as a "two-leaf" clover or, respectively, as a double barrel structure. A paint spraygun constructed in accordance with the present invention is particularly suitable for guns working with high paint pressure and auxiliary compressed air, whereby essentially no modifications are necessary over the exemplary embodiment, whereby modifications would at most affect only the design of the air discharge openings at the forward end of the pistol tube.

Although we have described our invention by reference to particular embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. In a hand-held electrostatic spraygun of the type in which a pistol tube of insulating material is mounted on a gun body and mounts a spray nozzle and an electrode, in which the gun body has a handle and a paint input connection, for receiving paint, in communication with the spray nozzle and an indulstion-clad high-voltage generator connectible via switch and a high-voltage conductor to the electrode, the improvement wherein:

said gun body comprises a forward end mounting said pistol tube, a paint channel at said forward end, said paint input connection mounted adjacent said forward end and adjacent said pistol tube and in communication with said paint channel, and an air input for receiving compressed air;

said pistol tube comprises a cross-section defining a plurality of lobes, a first of said lobes comprising a first passageway for said high-voltage conductor, a second of said lobes comprising a second passageway for connecting said air input to said spray nozzle, and a central passageway connecting said paint channel to said spray nozzle; and said high-voltage generator is connected to said gun body rearwardly of said paint input connection and comprises an outer insulation shaped as a pistol grip and forming the handle for the spraygun.

2. The improved spraygun of claim 1, wherein:

said gun body is aluminum; and said insulation is plastic.

3. The improved spraygun of claim 1, wherein:

said gun body comprises a trigger, an elongate control passageway for communication with said paint channel, a paint valve at the juncture of said paint channel and said control passagway, an air input for communication with said control passageway, an air valve at the juncture of said air input and said control passageway and coupled to said paint valve and said trigger, and air passage means extending through said body and said pistol tube between said air valve and said second passageway.

4. The improved spraygun of claim 3, wherein:

said spray nozzle comprises atomizing air apertures and control air apertures for controlling the spray cloud; and said air passage means comprises first and second air passages extending separately through said gun body from said air valve, third and fourth passageways in third and fourth ones of said plurality of lobes respectively in communication with said first and second air passages and with said atomizing air apertures and said control air apertures.

5. The improved spraygun of claim 4, wherein:

said air valve comprises first and second control flanges, said second control flange displaceable via said trigger to open said air valve and then engage said first control flange which is coupled to and displaceable to open said paint valve.

6. The improved spraygun of claim 5, and further comprising:

a pair of variable regulating members mounted in said gun body and in respective ones of said first and second air passages for controlling the quantity of air passing therethrough.

7. The improved spraygun of claim 3, wherein:

said air input comprises an elongate tube extending along said high-voltage generator on the rear side thereof.

8. The improved spraygun of claim 3, wherein:

said switch comprises a proximity switch for connecting said high-voltage generator to said conductor, said proximity switch operated by the movement of said trigger.

9. In a hand-held electrostatic spraygun of the type in which a pistol tube of insulating material is mounted on a gun body and mounts a spray nozzle and an electrode, in which the gun body has a handle and a paint input connection, for receiving paint, in communication with the spray nozzle and an insulation-clad high-voltage generator connectible via a switch and a high-voltage conductor to the electrode, the improvement wherein:

said gun body comprises a forward end mounting said pistol tube, a paint channel at said forward end, said paint input connection mounted adjacent said forward end and adjacent said piston tube and in communication with said paint channel;

said pistol tube comprises a cross-section in the shape of a three-leaf clover, a central passageway communicating with said paint channel and said spray nozzle, a first passageway in a first of said leaves housing said high-voltage conductor, and second and third passageways in second and third ones of said leaves, respectively, in communication with said spray nozzle;

said high-voltage generator is connected to said gun body rearwardly of said paint input connection and comprises an outer insulation shaped as a pistol grip and forming the handle for the spray gun; and air input means mounted on said body parallel to said high-voltage generator and including air passageway means extending through said body and communicating with said second and third passageways.

* * * * *